US009366400B2

(12) United States Patent
Liu

(10) Patent No.: US 9,366,400 B2
(45) Date of Patent: Jun. 14, 2016

(54) ILLUMINATION LAMP WITH INTEGRATED SWITCH AND ALARM

(75) Inventor: Yun-Zhao Liu, Guangdong Province (CN)

(73) Assignee: Guangdong Jetfast Portable Lighting Co., Ltd., Guangdong (CN)

( * ) Notice: Subject to any disclaimer, the term of this patent is extended or adjusted under 35 U.S.C. 154(b) by 495 days.

(21) Appl. No.: 13/885,019

(22) PCT Filed: Nov. 17, 2010

(86) PCT No.: PCT/CN2010/078822

§ 371 (c)(1), (2), (4) Date: May 13, 2013

(87) PCT Pub. No.: WO2012/065302

PCT Pub. Date: May 24, 2012

(65) Prior Publication Data

US 2013/0223050 A1 Aug. 29, 2013

(51) Int. Cl.

| | |
|---|---|
| ***F21L 4/00*** | (2006.01) |
| ***F21V 23/04*** | (2006.01) |
| ***F21V 33/00*** | (2006.01) |
| ***F21V 23/00*** | (2015.01) |
| *F21Y 101/02* | (2006.01) |
| *G08B 15/00* | (2006.01) |

(52) U.S. Cl.

CPC . *F21L 4/00* (2013.01); *F21L 4/005* (2013.01); *F21V 23/006* (2013.01); *F21V 23/04* (2013.01); *F21V 23/0421* (2013.01); *F21V 33/0076* (2013.01); *F21Y 2101/02* (2013.01); *G08B 15/004* (2013.01)

(58) Field of Classification Search

CPC ..... F21L 4/00; F21L 4/005; F21L 7/00; F21L 15/06; F21L 19/00; F21L 19/006; F21L 4/027; F21V 23/0114

USPC ..... 362/205, 171, 157, 202, 208; 340/321

See application file for complete search history.

(56) References Cited

U.S. PATENT DOCUMENTS

| | | | | |
|---|---|---|---|---|
| 5,086,377 | A * | 2/1992 | Roberts | F21V 33/0064 222/113 |
| 5,934,784 | A * | 8/1999 | Dion | A43B 1/0036 362/103 |
| 7,496,001 | B2 * | 2/2009 | Theriault | F21L 4/005 367/141 |
| 7,654,275 | B2 * | 2/2010 | Ewell | A45B 3/00 135/66 |
| 7,889,088 | B1 * | 2/2011 | Billman | A62B 3/00 340/627 |
| 8,197,085 | B2 * | 6/2012 | Spartano | F21L 4/027 315/209 R |

* cited by examiner

*Primary Examiner* — Jong-Suk (James) Lee
*Assistant Examiner* — Mark Tsidulko
(74) *Attorney, Agent, or Firm* — Rosenberg, Klein & Lee

(57) ABSTRACT

An illumination lamp with integrated switch and alarm functions includes a main body (1), batteries (2), a conductive seat (3), a controller (4), a light source assembly (5), an end cover (6) and an alarm (8). The alarm (8) is disposed within the inner cavity of the end cover (6), and the housing of the alarm (8) slidably matches the inner cavity of the end cover (6). The alarm (8) is electrically connected to the controller (4). The bottom of the alarm (8) works together with a light-touch switch (7), and the top of the alarm (8) is an operation end. During use, the alarm (8) is pressed downwards to touch and activate the light-touch switch (7), thereby realizing lighting function or alarming function.

2 Claims, 3 Drawing Sheets

ILLUMINATION LAMP WITH INTEGRATED SWITCH AND ALARM

FIELD OF THE INVENTION

The present invention relates to an illumination lamp with integrated switch and alarm functions, especially to an illumination lamp with lithium ion batteries.

DESCRIPTION OF RELATED ART

An illumination lamp with lithium ion batteries available now includes a main body, at least one lithium ion battery, a conductive seat, a controller, a light source assembly, and an end cover. An opening at one end of the end cover is disposed with an inner thread while an opening on the other end thereof is an operation opening. The conductive seat cooperates with the inner thread to be fixed in the end cover. An outer thread of the main body is connected to the inner thread of the end cover. The conductive seat is arranged with a positive spring and a negative spring, both working together with the lithium ion battery. The controller consists of a controller circuit board and a microcontroller. The controller circuit board is fixed on the conductive seat and a light-touch switch is connected to the microcontroller on the controller circuit board. One end of the lithium ion battery matches the light source assembly while the other end thereof works together with the positive and negative springs of the conductive seat. An operation film arranged at the operation opening works together with the light-touch switch. In use, the light-touch switch sends a signal once the operation film is touched and activated. Then the controller works so that the light source assembly emits light. The light source assembly can be operated continuously to change light intensity or turned off.

However, the illumination lamp with lithium ion batteries available now has the problem that it can only be used for lighting. The illumination lamp is a single function lamp, unable to be used as an alarm buzzer.

SUMMARY OF THE INVENTION

Therefore it is a primary object of the present invention to provide an illumination lamp with integrated switch and alarm functions that not only controls illumination but also provides warning function. The illumination lamp with integrated switch and alarm functions is an essential survival tool for emergency conditions in all weathers. When people, especially elders, are in need of help or rescue and they activate the alarm, rescue workers learn the position of people in need of help according to sounds of the alarm. This gives the rescue team orientation to rescue people in time and the valuable time is saved.

In order to achieve the above object, an illumination lamp with integrated switch and alarm functions of the present invention includes a main body, a lithium ion battery, a conductive seat, a controller, a light source assembly, and an end cover. The conductive seat is disposed with a positive spring and a negative spring that work together with the lithium ion battery. The controller includes a controller circuit board and a microcontroller. The controller circuit board is secured on the conductive seat and a light-touch switch is connected to the microcontroller on the controller circuit board. An inner thread is arranged in an opening at one end of the end cover while an opening on the other end of the end cover is an operation opening. The conductive seat matches the inner thread to be fixed in the end cover. An outer thread of the main body is connected to the inner thread of the end cover. The illumination lamp with integrated switch and alarm functions of the present invention features on that it further includes an alarm.

An outer surface of a housing of the alarm is disposed with an outer circular base and an inner wall of one end of the end cover with the operation opening is arranged with a stopper base. The alarm is disposed within an inner cavity of the end cover and between the stopper base and the conductive seat. The housing of the alarm slidably matches the inner cavity of the end cover. The outer circular base works together with the stopper base for stopping.

The alarm is electrically connected to the controller and the bottom of the alarm works together with the light-touch switch. The top of the alarm is an operation end.

The illumination lamp is characterized in that it further includes a conductive member that is composed of a conductive spring, a conductive spring cover and a guide seat.

The conductive spring is fixed on the controller circuit board and the conductive spring cover is disposed around the conductive spring. The conductive spring cover slidably matches a guide hole of the guide seat while the guide seat is fixed on and connected to the controller circuit board. The conductive spring cover is electrically connected to an alarm circuit board of the alarm.

The illumination lamp with integrated switch and alarm functions features on that an inner circular base is mounted in the guide hole while the conductive spring cover is arranged with an outer circular edge. The outer circular edge and the inner circular base work together for stopping.

The illumination lamp with integrated switch and alarm functions of the present invention with the structure mentioned above works by pressing the alarm through the end of the end cover with the operation opening. Then the alarm is moved downwards to touch and activate the light-touch switch. At the same time, light pressing of the alarm can either select light sources of the light source assembly or make the alarm buzz. Thus the present invention is not only an illumination device but also with alarming function, easy to use.

Thereby it is a primary object of the present invention to provide a double loop LED (light emitting diode) tube light without direction limit while being connected to light fixtures.

It is another object of the present invention to provide a double loop LED light assembly that includes at least one double loop LED tube light.

It is a further object of the present invention to provide a double loop LED tube light. While assembling the LED tube light to conventional fluorescent light fixtures, there is no need to disassemble a starter disposed in the conventional fluorescent light fixtures.

In order to achieve the above objects, the LED tube light includes a first rectifier circuit and a second rectifier circuit. One end of an AC input terminal of the first rectifier circuit is connected to a first end contact of the tube light while the other end thereof is connected to a second end contact of the tube light. One end of an AC input terminal of the second rectifier circuit is connected to a first end contact of the tube light while the other end thereof is connected to a second end contact of the tube light. The double loop LED tube light is connected to a ballast and a starter to form a LED light assembly.

Compared with products available now, the double loop LED tube light of the present invention can be lighted up smoothly without being limited by the light assembly while being connected to a new designed light assembly or applied to conventional LED light assembly. The LED tube light of the present invention is suitable for conventional fluorescent light (such as T5 fluorescent light) or new designed LED light assembly.

Moreover, the starter originally arranged in the conventional fluorescent light will not be disassembled when users arrange the double loop LED tube light at the conventional fluorescent light fixture. The trouble in replacement and use can be avoided.

The embodiments of the present invention are described in the following paragraphs with reference to the drawings.

THE REFERENCE NUMERALS

| | |
|---|---|
| 1 main body | 11 outer thread |
| 2 lithium ion battery | 3 conductive seat |
| 31 positive spring | 32negative spring |
| 4 controller | 41 controller circuit board |
| 5 light source assembly | 6 end cover |
| 61 inner thread | 62 operation opening |
| 63 stopper base | 7 light-touch switch |
| 8 alarm | 81 housing |
| 811 outer circular base | 82 alarm circuit board |
| 821 positive contact of a power supply | |
| 822 negative contact of a power supply | |
| 9 conductive member | 91 conductive spring |
| 92 conductive spring cover | 921 outer circular edge |
| 93 guide seat | 931 guide hole |
| 932 inner circular base | |

DETAILED DESCRIPTION OF THE PREFERRED EMBODIMENT

The details of the present invention are shown in the following description with reference of the figures.

Figure 1:
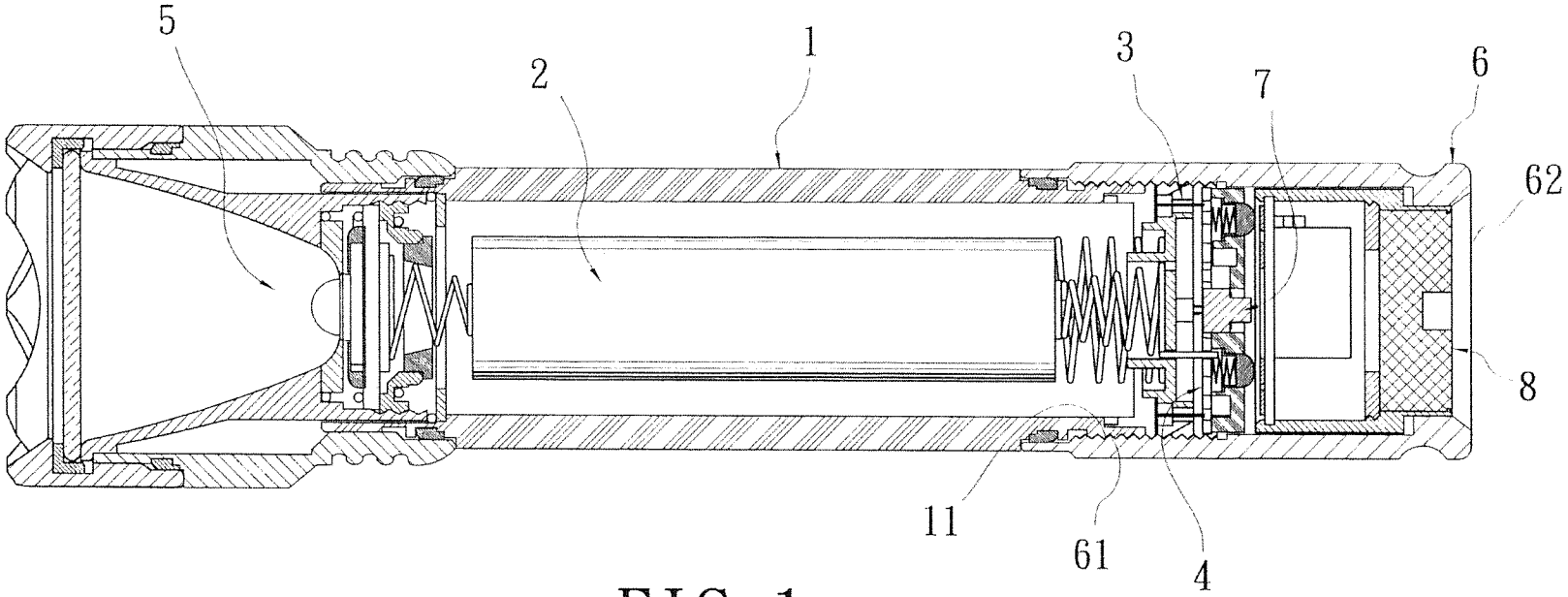
FIG. 1 is a cross sectional view of an embodiment according to the present invention.
Figure 2:
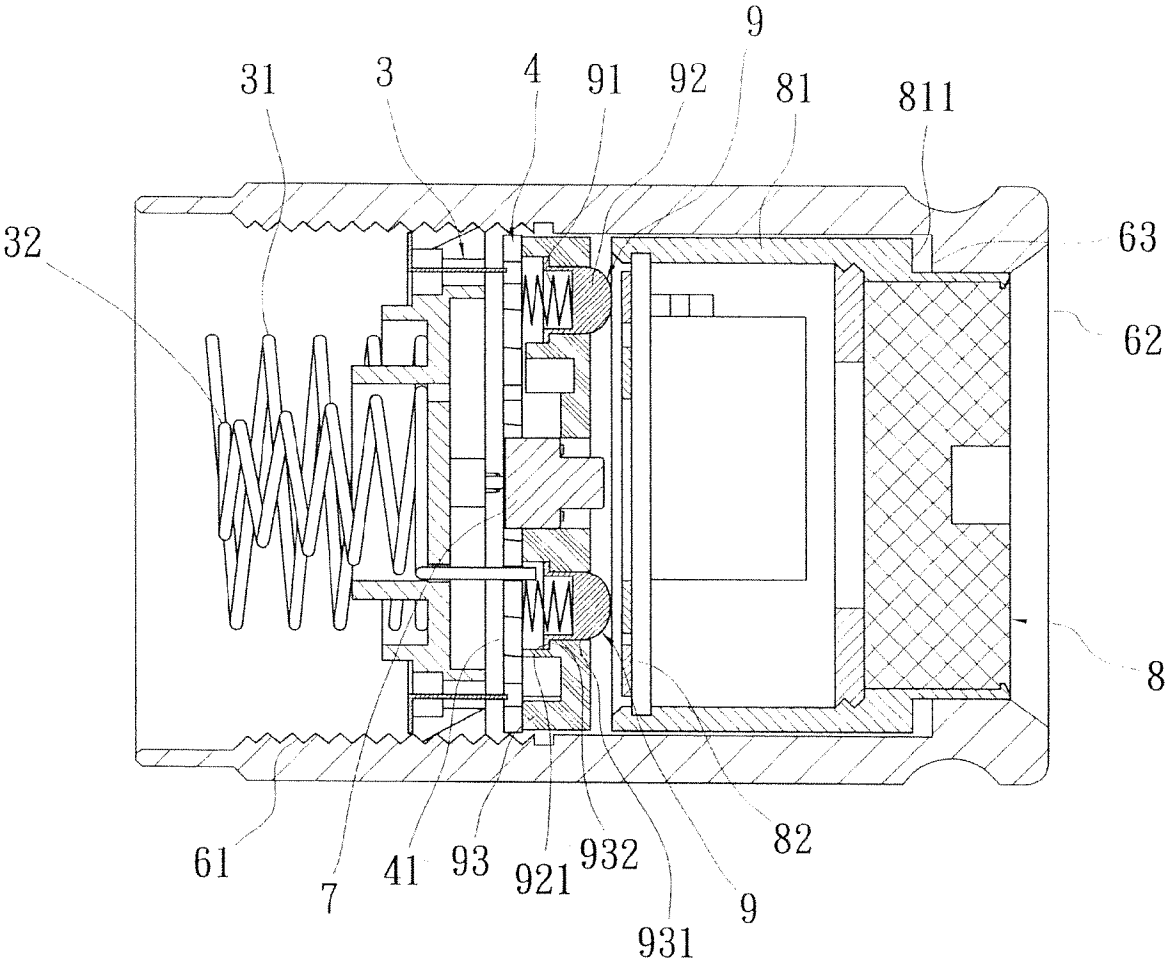
FIG. 2 is a partial enlarged view of the embodiment in FIG. 1 according to the present invention.

As shown in FIG. 1 and FIG. 2, an illumination lamp with integrated switch and alarm functions includes a main body 1, a lithium ion battery 2, a conductive seat 3, a controller 4, a light source assembly 5, and an end cover 6. The conductive seat 3 is disposed with a positive spring 31 and a negative spring 32 that work together with the lithium ion battery 2. The controller 4 includes a controller circuit board 41 and a microcontroller (not shown in figure). The controller circuit board 41 is fixed on the conductive seat 3 and a light-touch switch 7 is connected to the microcontroller on the controller circuit board 41. An inner thread 61 is mounted in an opening at one end of the end cover 6 while the other end of the end cover 6 is an operation opening 62. The conductive seat 3 matches the inner thread 61 of the end cover 6 to be fixed in the end cover 6. An outer thread 11 of the main body 1 is connected to the inner thread 61 of the end cover 6.

The illumination lamp further includes an alarm 8. An outer surface of a housing 81 of the alarm 8 is arranged with an outer circular base 811. A stopper base 63 is disposed on an inner wall of one end of the end cover 6 with the operation opening 62. The alarm 8 is disposed within an inner cavity of the end cover 6 and between the stopper base 63 and the conductive seat 3. The housing 81 of the alarm 8 slidably matches the inner cavity of the end cover 6. The outer circular base 811 cooperates with the stopper base 63 for stopping. The alarm 8 is electrically connected to the controller 4. The bottom of the alarm 8 works together with the light-touch switch 7 and the top of the alarm 8 is an operation end.

The illumination lamp further includes two conductive members 9. One conductive member connects a positive electrode of a power supply of the controller 4 to a positive electrode of a power supply of the alarm 8 while the other conductive member connects a negative electrode of a power supply of the controller 4 to a negative electrode of a power supply of the alarm 8.

The conductive member 9 consists of a conductive spring 91, a conductive spring cover 92 and a guide seat 93.

The conductive spring 91 is fixed on the controller circuit board 41 and the conductive spring cover 92 is disposed around the conductive spring 91. The conductive spring cover 92 slidably matches a guide hole 931 of the guide seat 93 while the guide seat 93 is fixed on and connected to the controller circuit board 41. The conductive spring cover 92 is electrically connected to an alarm circuit board 82 of the alarm 8.

While in use, the alarm 8 is pressed and moved downwards to touch and activate the light-touch switch 7. Then lighting function or buzzing of the alarm 8 is selected. At the same time, the conductive spring 91 is compressed. After user's hand leaving the alarm 8, the alarm 8 turns back to the original position due to the conductive spring 91. The conductive spring 91 is used to keep the conductive spring cover 92 in good contact with the alarm circuit board 82.

Figure 3:
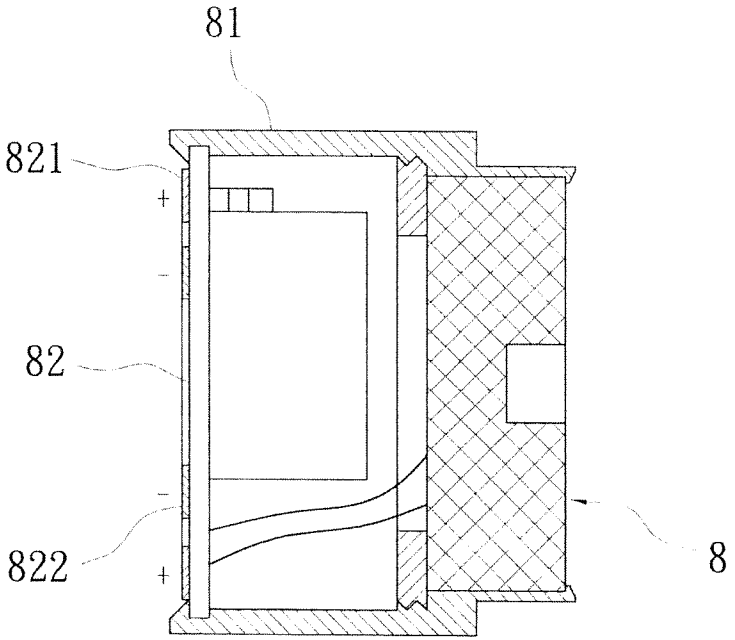
FIG. 3 is a cross sectional view of an alarm of an embodiment according to the present invention.

As shown in FIG. 3 (also refer to FIG. 2), the alarm circuit board 82 is located at the bottom of the housing 81. The alarm circuit board 82 is arranged with a positive power contact (positive contact of a power supply) 821 and a negative contact of a power supply 822. The positive contact of the power supply 821 and the negative contact of the power supply 822 respectively work together with one conductive spring cover 92 for conducting electricity.

The guide hole 931 is disposed with an inner circular base 932 while the conductive spring cover 92 is arranged with an outer circular edge 921. The outer circular edge 921 and the inner circular base 932 work together for stopping.

The invention claimed is:

1. An illumination lamp with integrated switch and alarm functions comprising a main body, a lithium ion battery, a conductive seat, a controller, a light source assembly, and an end cover; the conductive seat is disposed with a positive spring and a negative spring that work together with the lithium ion battery; the controller includes a controller circuit board and a microcontroller while the controller circuit board is fixed on the conductive seat and a light-touch switch is connected to the microcontroller on the controller circuit board; an inner thread is arranged in an opening at one end of the end cover while an opening on the other end of the end cover is an operation opening; the conductive seat matches the inner thread to be fixed in the end cover; an outer thread of the main body is connected to the inner thread of the end cover;

wherein the illumination lamp further includes an alarm in which an outer circular base is disposed on an outer surface of a housing thereof; a stopper base is arranged at an inner wall of one end of the end cover with the operation opening; the alarm is disposed within an inner cavity of the end cover and between the stopper base and the conductive seat; the housing of the alarm slidably matches the inner cavity of the end cover and the outer circular base cooperates with the stopper base for stopping; the alarm is electrically connected to the controller; a bottom of the alarm works together with the light-touch switch and a top of the alarm is an operation end; and wherein the illumination lamp further includes a conductive member and the conductive member having a conductive spring, a conductive spring cover and a guide seat; the conductive spring is fixed on the controller circuit board and the conductive spring cover is disposed around the conductive spring; the conductive spring cover slidably matches a guide hole of the guide seat while the guide seat is fixed on and connected to the controller circuit board; the conductive spring cover is electrically connected to an alarm circuit board of the alarm.

2. The device as claimed in claim 1, wherein an inner circular base is mounted in the guide hole while the conductive spring cover is arranged with an outer circular edge; the outer circular edge and the inner circular base work together for stopping.

* * * * *